US009995548B1

(12) United States Patent
Zhou

(10) Patent No.: US 9,995,548 B1
(45) Date of Patent: Jun. 12, 2018

(54) RAPID RELOADING SYSTEM FOR REMOVABLE AMMUNITION MAGAZINES

(71) Applicant: Junsheng Zhou, Bensalem, PA (US)

(72) Inventor: Junsheng Zhou, Bensalem, PA (US)

( * ) Notice: Subject to any disclaimer, the term of this patent is extended or adjusted under 35 U.S.C. 154(b) by 0 days. days.

(21) Appl. No.: 15/842,874

(22) Filed: Dec. 14, 2017

(51) Int. Cl.
*F41A 9/83* (2006.01)
*F41A 9/82* (2006.01)

(52) U.S. Cl.
CPC ..... *F41A 9/83* (2013.01)

(58) Field of Classification Search
CPC ..... F41A 9/82; F41A 9/83; F41A 9/84
USPC ..... 86/45, 47; 42/87, 88
See application file for complete search history.

(56) References Cited

U.S. PATENT DOCUMENTS 452,447 A * 5/1891 Bruce ..... F41A 9/84 42/88
1,786,537 A * 12/1930 Holek ..... F41A 9/83 42/87
2,356,806 A * 8/1944 Woodberry ..... F42B 39/10 221/269
2,402,195 A * 6/1946 Woodberry ..... F42L 339/10 42/88
2,403,012 A 7/1946 McPheters
2,542,842 A * 2/1951 Saunders ..... A47F 1/06 206/3
2,887,811 A * 5/1959 Johnson, Jr. ..... F41A 9/84 42/87
2,981,024 A * 4/1961 Skoff ..... F41A 9/83 42/50
3,283,425 A * 11/1966 Boyd ..... F42B 33/002 86/36
4,538,371 A * 9/1985 Howard ..... F41A 9/84 42/87
4,574,511 A * 3/1986 Csongor ..... F41A 9/84 42/87
4,614,052 A 9/1986 Brown et al.
4,706,402 A * 11/1987 Csongor ..... F41A 9/84 42/87
4,707,941 A * 11/1987 Eastman ..... F41A 9/68 42/49.02
4,939,862 A * 7/1990 Brandenburg ..... F41A 9/83 42/87
5,301,449 A 4/1994 Jackson
5,747,718 A * 5/1998 Bill ..... F42B 33/00 29/525
9,574,836 B1 * 2/2017 Cauley, Jr. ..... F41A 9/83
(Continued)

*Primary Examiner* — Derrick R Morgan
(74) *Attorney, Agent, or Firm* — LaMorte & Associates, P.C.

(57) ABSTRACT

A reloading system and method for reloading cartridges into a removable ammunition magazine of a gun. The reloading system has a storage container for holding a supply of cartridges. A plurality of parallel walls creates columns within the internal chamber that are capable of holding multiple cartridges in stacked configurations. Each of the columns holding cartridges supply the cartridges to a common loading chamber. A loading port is provided on the storage container that leads into the common loading chamber. The loading port and the common loading chamber are sized to receive at least a portion of a magazine. As the magazine is advanced into the loading chamber, the cartridges held in the loading chamber pass into the magazine. The magazine is then removed from the loading chamber, wherein the cartridges remain within the magazine.

17 Claims, 6 Drawing Sheets

(56) References Cited

U.S. PATENT DOCUMENTS

| | | | | |
|---|---|---|---|---|
| 9,689,633 | B1 * | 6/2017 | Plate | F41A 9/83 |
| 2013/0067788 | A1 * | 3/2013 | Gray | F41A 9/84<br>42/88 |
| 2014/0033592 | A1 * | 2/2014 | Fiorucci | F41A 9/83<br>42/87 |
| 2014/0298704 | A1 * | 10/2014 | Niccum | F41A 9/83<br>42/87 |
| 2014/0317985 | A1 * | 10/2014 | Cauley, Jr. | F41A 9/83<br>42/87 |
| 2014/0373421 | A1 * | 12/2014 | Hatch | F41A 9/83<br>42/87 |

* cited by examiner

RAPID RELOADING SYSTEM FOR REMOVABLE AMMUNITION MAGAZINES

BACKGROUND OF THE INVENTION

1. Field of the Invention

In general, the present invention relates to systems and methods for rapidly reloading ammunition into the removable magazine of a rifle or pistol. More particularly, the present invention relates to portable systems that hold a large number of ammunition cartridges, wherein the system can be repeatedly used to rapidly refill an ammunition magazine by a soldier in the field.

2. Prior Art

Many makes and models of rifles and pistols are loaded using removable ammunition magazines. An ammunition magazine is a plastic or metal structure that is generally shaped like a box. The magazine has one open end. Inside the magazine is a spring biased platform. As cartridges are inserted into the magazine, the cartridges displace the platform against the spring bias. Once inserted into the magazine, the cartridges are biased toward the open end of the magazine. When the magazine is inserted into a rifle or pistol, the open end of the magazine is exposed to the breech of the gun. As the gun cycles, a cartridge is mechanically extracted from the magazine and loaded for firing.

The use of ammunition magazines is popular because it greatly decreases the amount of time and labor that is involved with reloading a gun. Using replaceable magazines, a rifle or pistol can be fully reloaded in only a few seconds. As a gun is being loaded, it cannot be fired. As such, it is very important to military personnel and law enforcement that the time required to reload the gun is minimal.

One disadvantage of using removable ammunition magazines is that it takes a significant amount of time and labor to reload the magazine after the magazine is emptied. Accordingly, soldiers, police officers and the like do not attempt to reload empty magazines while in dangerous situations. Rather, soldiers and police officers prefer to carry a few preloaded magazines. When the magazines are empty, the soldier or officer is out of ammunition and must retreat to a safe location to either reload the empty magazines or to obtain additional preloaded magazines.

In the prior art, there are a myriad of devices that exist to reduce the time and labor needed to reload an ammunition magazine. Many of these devices are not designed to be portable and are impractical for use by a soldier or an officer in the field. Most other prior art devices, require the pressing of a lever or the turning of a crank to advance cartridges into an empty magazine. Consequently, such prior art devices require two hands to operate. One hand is needed to hold the reloading device and the other hand is needed to operate the reloading device. If a soldier needs two hands to reload ammunition into magazines, they must place down their weapon to free their hands. Obviously, this is undesirable on a battlefield or other dangerous situations. Prior art magazine reloading devices that require two hands to operate are exemplified by U.S. Pat. No. 4,574,511 to Csongor and U.S. Patent Application No. 2014/0033592 to Fiorucci.

Another disadvantage of prior art magazine reloading systems is that they typically only hold enough ammunition to reload a magazine one or two times. Since the reloading system is typically significantly larger than a magazine, it is much more practical to carry one or two extra pre-filled magazines than it is to carry one magazine reloading system.

A need therefore exists for a magazine reloading system that has the capacity and size to make it more practical to carry than pre-filled magazines. A need also exists for a magazine reloading system that refills an empty magazine in only a few seconds and can be operated with only one hand. These needs are met by the present invention as described and claimed below.

SUMMARY OF THE INVENTION

The present invention is a reloading system and method for reloading cartridges into a removable ammunition magazine of a gun. The reloading system has a storage container that defines an internal compartment for holding a supply of cartridges. A plurality of parallel walls are positioned in the internal compartment. The parallel walls create columns within the internal chamber that are capable of holding multiple cartridges in stacked configurations. Each of the columns holding cartridges supply the cartridges to a common loading chamber.

A loading port is provided on the storage container that leads into the common loading chamber. The loading port and the common loading chamber are sized to receive at least a portion of a magazine therein. As the magazine is advanced into the loading chamber, the cartridges held in the loading chamber pass into the magazine. The magazine is then removed from the loading chamber, wherein the cartridges remain within the magazine.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention magazine reloading system can be used to reload many types of removable ammunition magazines, the magazine reloading system is shown in only one illustrated embodiment. The exemplary embodiment shows the magazine reloading system being used to reload a magazine with a capacity of seven rounds. The embodiment is selected for ease of description and illustration, wherein the exemplary embodiment sets forth one of the best modes contemplated for the invention. The illustrated embodiment, however, is merely exemplary and should not be considered a limitation when interpreting the scope of the appended claims.

Figure 2:
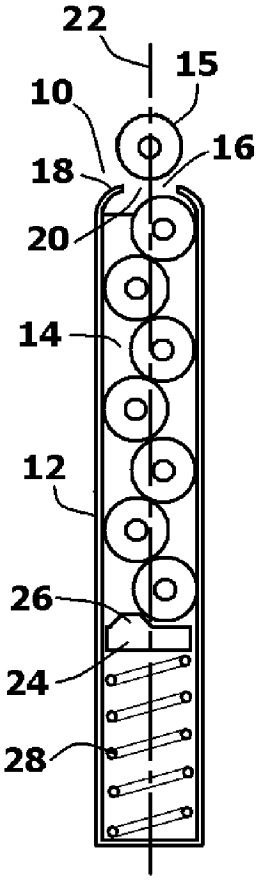
FIG. 2 is a cross-sectional view of the embodiment of FIG. 1 viewed on section line 2-2.
Figure 1:
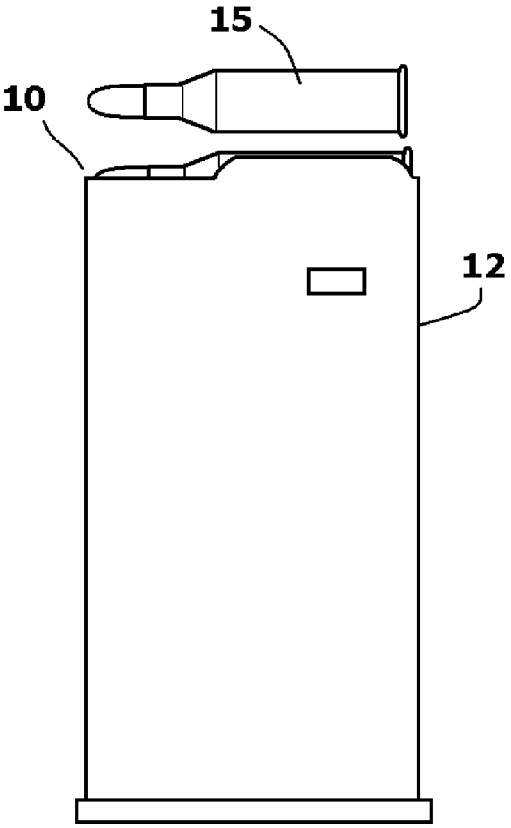
FIG. 1 is a side view of a prior art ammunition magazine.

Referring to FIG. 1 in conjunction with FIG. 2, a prior art removable ammunition magazine 10 is shown. The ammunition magazine 10 has a housing 12. The housing 12 is typically metal or molded plastic. The housing 12 defines an internal chamber 14 that is sized to retain the ammunition cartridges 15 of a particular length and caliber. The internal chamber 14 is accessed through an opening 16 at one end of the housing 12. The opening 16 is partially obstructed by flared stops 18 that overlap sections of the opening 16. The flared stops 18 are positioned on opposite sides of the opening 16. The flared stops 18 extend a first distance D1 over the opening 16. A gap space 20 exists between the flared stops 18. The gap space 20 is aligned with the centerline 22 of the internal chamber 14. The gap space 20 is just wide enough to enable a cartridge 15 to pass through the gap space 20. In this manner, cartridges 15 can be loaded into the magazine 10 by manually advancing the cartridges 15 through the gap spaces 20.

Inside the internal chamber 14 is a platform 24. The platform 24 has a contoured surface 26. The contoured surface 26 causes any cartridge 15 that may be resting on the platform 24 to be positioned off-center from the centerline 22 of the internal chamber 14. In this manner, the cartridges 15 within the housing 12 do not directly align with the gap space 20 between the flair stops 18. This prevents the cartridges 15 from falling out of the magazine 10 through the gap space 20. The platform 24 is biased toward the opening 16 by a spring 28. Accordingly, any cartridge 15 resting on the contoured platform 24 is also biased toward the opening 16. Due to the offset of the cartridges 15 caused by the contoured surface 26 of the platform 24, the cartridges 15 become wedged under the flared stops 18 and are prevented from falling out of the magazine 10.

Figure 3:
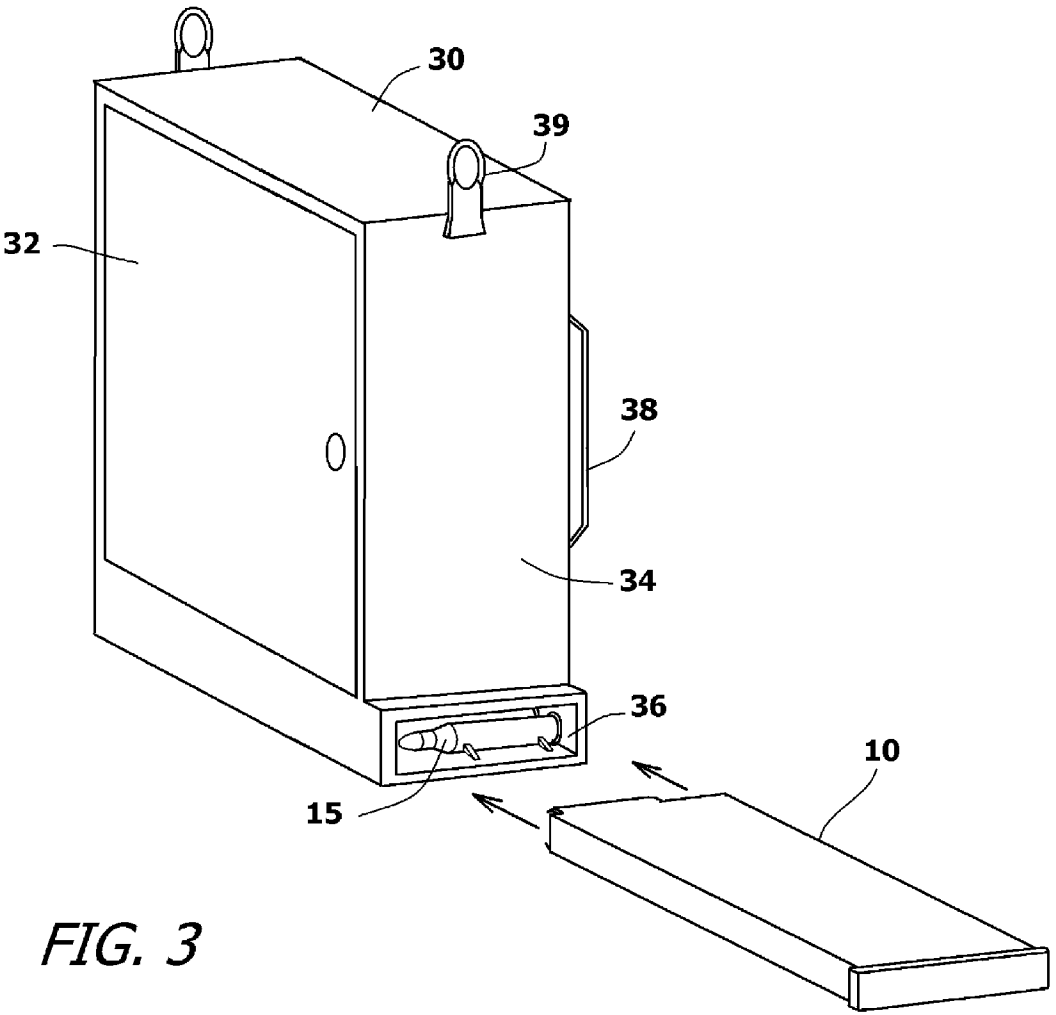
FIG. 3 shows the present invention reloading system in conjunction with the ammunition magazine of FIG. 1.

Referring to FIG. 3 in conjunction with FIG. 2, a reloading system 30 is shown. The reloading system 30 includes a refillable storage container 32. The storage container 32 has the capacity to hold a large number of cartridges 15 arranged in parallel. The storage container 32 has a side wall 34. A loading port 36 is formed along the side wall 34. The loading port 36 is sized and shaped to receive the magazine 10. The magazine 10 is pressed into the loading port 36 so that the opening 16 of the magazine 10 enters the loading port 36 first.

As the magazine 10 enters the loading port 36, cartridges 15 are automatically advanced into the magazine 10, therein reloading the magazine 10. Accordingly, the magazine 10 can be reloaded as fast as the magazine 10 can be advanced into the loading port 36 of the storage container 32 and then pulled free. This takes only seconds. As a result, an empty magazine 10 can be reloaded nearly as fast as the magazine 10 can be replaced with another. The need to carry multiple magazines is, therefore, eliminated. A user need only carry the reloading system 30 and can reload the same magazine 10 multiple times.

The reloading system 30 is designed to be carried into action by a soldier or an officer. As such, the reloading system 10 can have belt loops 38, shoulder strap loops 39 or other such external features that enable the reloading system 30 to be easily carried.

Figure 4:
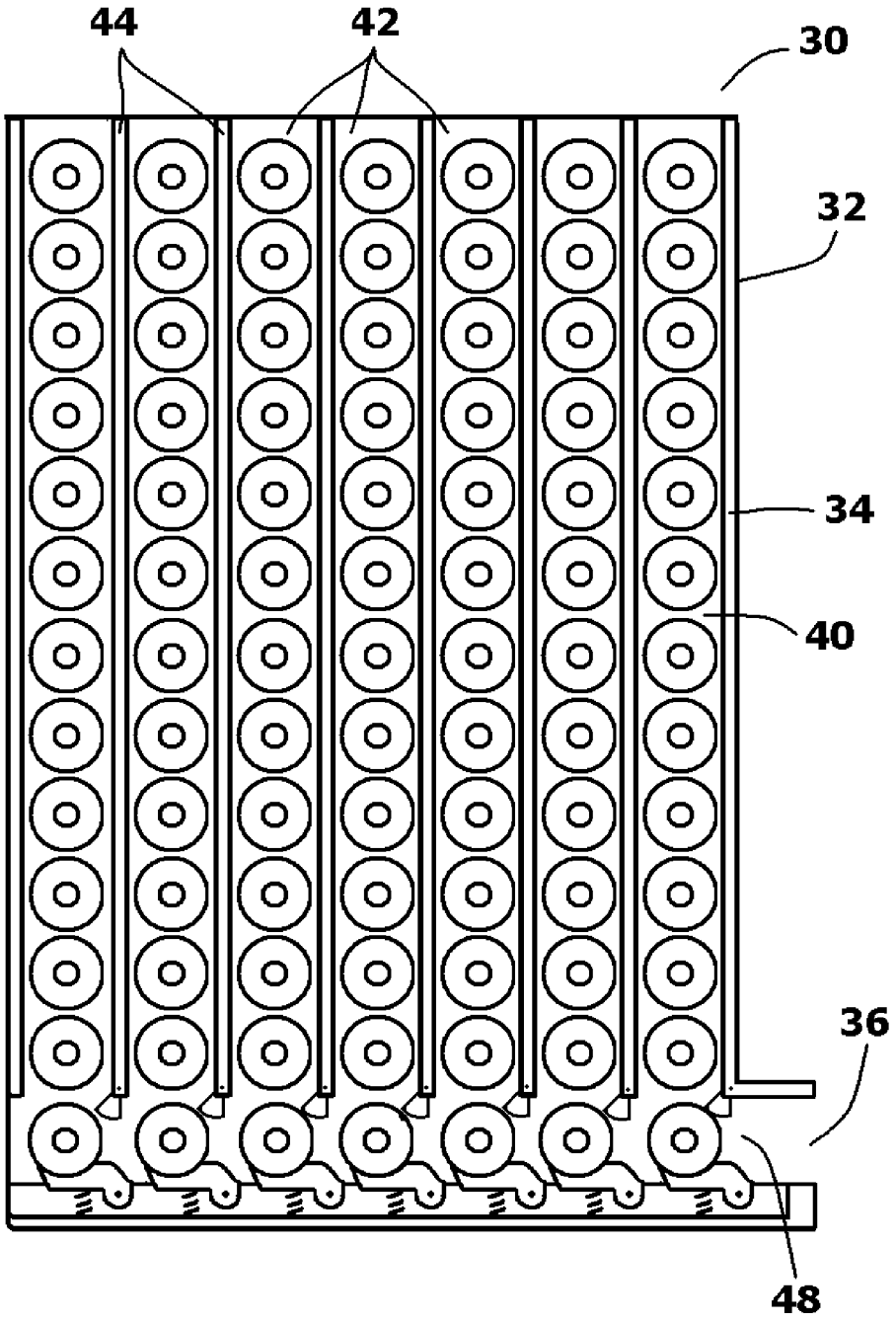
FIG. 4 shows a sectional view of the reloading system of FIG. 3.
Figure 5:
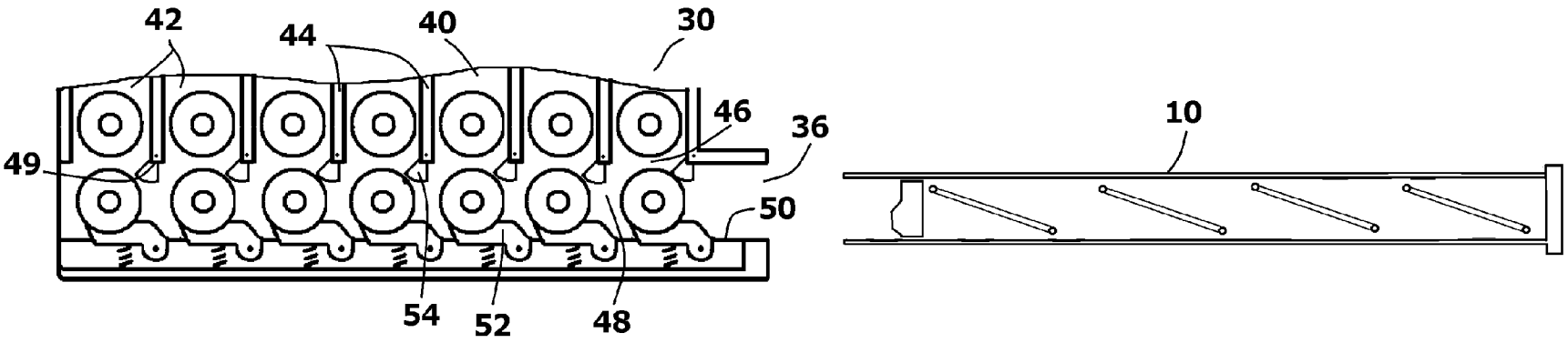
FIG. 5 is an enlarged view of a section of FIG. 4.

Referring to FIG. 4 and FIG. 5 in conjunction with FIG. 2 and FIG. 3, it can be seen that the storage container 32 defines an internal storage compartment 40. There are isolated columns 42 within the storage compartment 40 of the reloading system 30. The columns 42 are parallel and are separated by column walls 44. There is enough space to hold a stack of horizontal cartridges 15 within each column 42. The number of cartridges 15 that can be stacked within each column 42 and the number of columns 42 are determined by the space available within the storage container 32 and the size of the cartridges 15.

All of the columns 42 have open bottom ends 46 that face a common loading chamber 48. The loading chamber 48 is sized to receive the magazine 10 therein as the magazine 10 is inserted through the loading port 36. The loading chamber 48 has a top surface and an opposite bottom surface 50. The top surface is defined by the bottoms 49 of the column walls 44. The bottom surface 50 is a generally planar surface.

A plurality of spring loaded, retractable supports 52 are mounted along the bottom surface 50 of the loading chamber 48. The retractable supports 52 each extend to different elevations above the bottom surface 50 depending upon the size and the shape of the cartridge 15 to be supported. The retractable supports 52 are shaped and positioned to hold a cartridge 15 within the loading chamber 48 at least a distance D1 above the bottom surface 50. In this manner, when the magazine 10 is inserted into the loading chamber 48, the supported cartridges 15 clear the flared stops 18 and are aligned with the gap space 20 between the flared stops 18 on the magazine 10.

As the magazine 10 is advanced into the loading chamber 48, the magazine 10 contacts the retractable supports 52. When the retractable supports 52 are contacted by the advancing magazine 10, the contact rotates the retractable supports 52 into a retracted position that is flush with the bottom surface 50 of the loading chamber 48. Once the magazine 10 is removed, the retractable supports 52 automatically return to their extended positions.

Rotatable spacers 54 are also present in the loading chamber 48. The rotatable spacers 54 mount to the bottoms 49 of the column walls 44 so that the rotatable spacers 54 extend into the loading chamber 48. When the magazine 10 is not present in the loading chamber 48, the rotatable spacers 54 segment the loading chamber 48 under the columns 42 and inhibit cartridges 15 from moving out of position. As the magazine 10 is advanced into the loading chamber 48, the magazine 10 contacts the rotatable spacers 54. When the rotatable spacers 54 are contacted by the advancing magazine 10, they rotate into a retracted position that partially blocks the columns 42 above the loading chamber 48. Once the magazine 10 is removed, the rotatable spacers 54 automatically return to their extended positions.

Referring to FIG. 5 in conjunction with FIG. 4, it can be seen that the storage container 32 of the reloading system 30 is opened and cartridges 15 are placed into the columns 42. Gravity causes the cartridges 15 to fall into the loading chamber 48 below the columns 42. One cartridge 15 from each column 42 enters the loading chamber 48. The cartridges 15 are held in place under the columns 42 by the retractable supports 52 and the rotatable spacers 54. The result is that the loading chamber 48 is filled with a row of cartridges 15, wherein the number of cartridges 15 corresponds to the number of columns 42.

Referring to FIG. 5 in conjunction with FIG. 3 and FIG. 2, it can be seen that the magazine 10 is advanced into the loading chamber 48 through the loading port 36. The cartridges 15 in the loading chamber 48 are aligned with the gap space 20 between the flared stops 18 of the magazine 10. As the magazine 10 is advanced into the loading chamber 48, the cartridges 15 pass through the gap space 20 as the retractable supports 52 and the rotatable spacers 54 are displaced into retracted positions.

Figure 6:
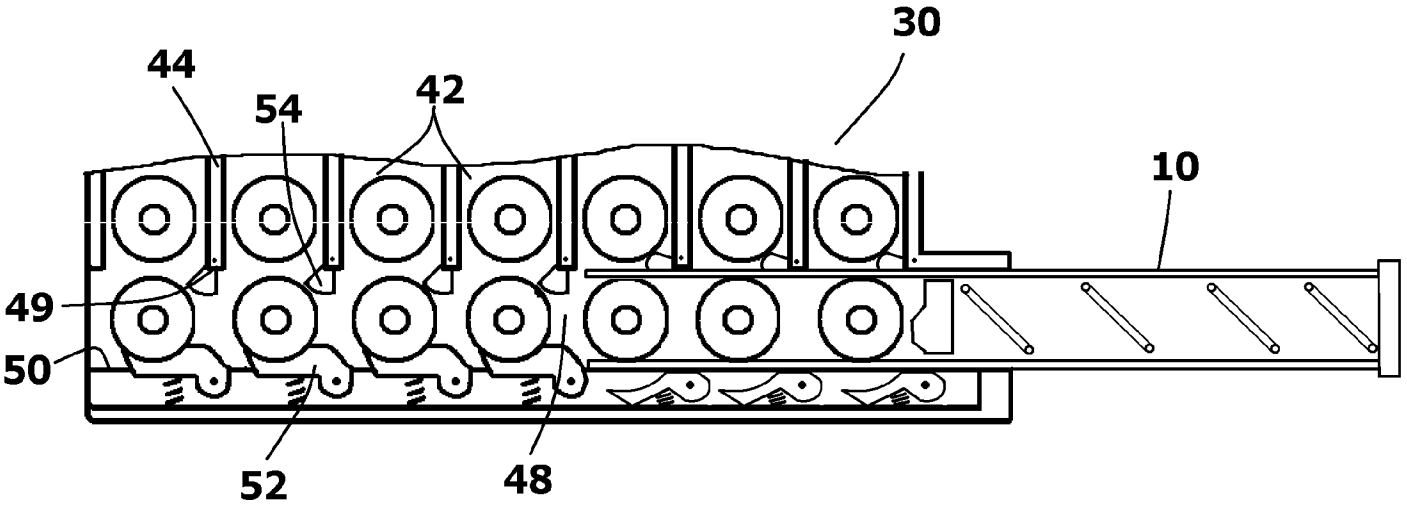
FIG. 6 is the enlarged view of FIG. 5 shown with a magazine partially inserted.
Figure 7:
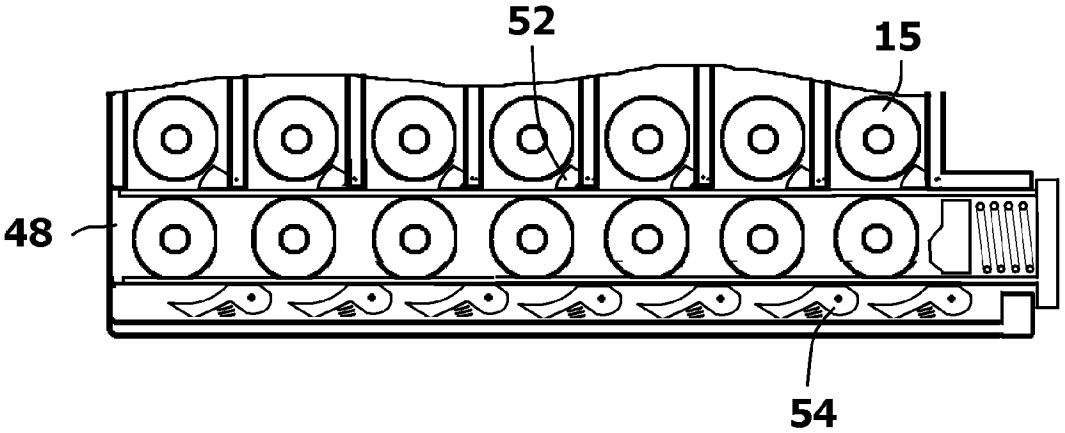
FIG. 7 is the enlarged view of FIG. 5 shown with a magazine fully inserted.

Refereeing to FIG. 6 and FIG. 7 in conjunction with FIG. 5 and FIG. 4, it can be seen that as the magazine 10 is advanced to the rear of the loading chamber 48, all of the cartridges 15 in the loading chamber 48 are transferred into the magazine 10 as the magazine 10 advances. As the magazine 10 is removed from the loading chamber 48, a new cartridge 15 from each column 42 automatically drops into the loading chamber 48 and the reloading system 30 is automatically primed for reuse.

In the primary embodiment, a reloading system 30 is shown that reloads seven cartridges 15 into a magazine 10 each time the magazine 10 is inserted into the reloading system 30. It will be understood that the use of seven cartridges 15 is arbitrary. The reloading system 30 can have any number of columns 42 and can hold any number of cartridges 15 in the loading chamber 48. Additionally, it should be understood that the same magazine 10 can be inserted into the reloading system 10 multiple time. For example, the reloading system 10 can be configured to present ten cartridges 15 in the loading chamber 48. A rifle magazine may be provided that has a capacity of thirty cartridges 15. To reload the magazine, the magazine would be inserted into the reloading system 30 three times in rapid succession. Each time the magazine is inserted into the reloading system 10, ten cartridges 15 are transferred into the magazine. Accordingly, after three insertions, the magazine would be at capacity.

It will be understood that the embodiment of the present invention that is illustrated and described is merely exemplary and that a person skilled in the art can make many variations to that embodiments. All such embodiments are intended to be included within the scope of the present invention as defined by the claims.

What is claimed is:

1. A reloading system for reloading cartridges into a removable ammunition magazine of a gun, said system comprising:

a storage container that defines an internal compartment;

a plurality of parallel walls within said internal compartment that creates columns within said internal compartment capable of holding a plurality of said cartridges in stacked configurations, wherein each of said columns leads into a common loading chamber; and a loading port formed in said storage container that leads into said common loading chamber, wherein said loading port and said common loading chamber are sized to receive at least a portion of said magazine therein;

further including retractable supports within said common loading chamber that support said cartridges in alignment with a gap opening of said magazine when said magazine is inserted into said loading chamber.

2. The reloading system according to claim 1, wherein said magazine has flared stops at a first end and said gap opening is between said flared stops for inserting cartridges into said magazine.

3. The reloading system according to claim 1, wherein said retractable supports retract when contacted by said magazine within said common loading chamber.

4. The reloading system according to claim 3, wherein said common loading chamber has a bottom surface over which said magazine advances, wherein said supports extend from and retract into said bottom surface.

5. The reloading system according to claim 1, wherein said retractable supports are shaped and positioned to retain said cartridges in set positions within said common loading chamber.

6. The reloading system according to claim 1, further including spacers coupled to said parallel walls, wherein said spacers rotate between a first position where said spacers extend into said common loading chamber and a second position where said spacers extend into said columns.

7. The reloading system according to claim 6, wherein said spacers are moved from said first position to said second position when contacted by said magazine within said common loading chamber.

8. A reloading system for reloading cartridges into a removable ammunition magazine of a gun, said system comprising:

a loading chamber accessible through a loading port, wherein said loading chamber has a bottom surface and an opposite top surface;

a plurality of supply columns that lead into said loading chamber through said top surface, wherein each of said supply columns retains a plurality of cartridges therein;

a plurality of retractable supports extending from said bottom surface into said loading chamber, wherein said supports retain said cartridges received from said plurality of supply columns in fixed positions within said loading chamber.

9. The reloading system according to claim 8, wherein said plurality of retractable supports retain said cartridges at an elevated position above said bottom surface of said loading chamber.

10. The reloading system according to claim 8, wherein said plurality of retractable supports are retracted when contacted by said magazine when said magazine is inserted into said loading chamber through said loading port.

11. The reloading system according to claim 8, further including spacers disposed proximate said plurality of supply columns in said loading chamber, wherein said spacers rotate between a first position where said spacers extend into said loading chamber and a second position where said spacers obstruct said supply columns.

12. The reloading system according to claim 11, wherein said spacers are moved from said first position to said second position when contacted by said magazine within said loading chamber.

13. A method of reloading cartridges into a removable ammunition magazine of a gun, said method comprising the steps of:

providing a loading chamber that is accessible through a loading port, wherein said loading chamber is connected to a stored supply of cartridges that fill said loading chamber with some of said cartridges each time said loading chamber is emptied;

providing supports in said loading chamber that orient said cartridges present within said loading chamber;

providing a magazine with flared stops at a first end and a gap opening between said flared stops for inserting cartridges into said magazine;

inserting said magazine into said loading chamber through said loading port, wherein said supports align said cartridges in said loading chamber with said gap opening and wherein said cartridges pass into said magazine through said gap opening as said magazine advances passed said cartridges within said loading chamber; and wherein said supports are retractable and retract when contacted by said magazine within said loading chamber.

14. The method according to claim 13, wherein said loading chamber has a bottom surface over which said magazine advances, wherein said supports extend from and retract into said bottom surface.

15. The method according to claim 13, wherein said supports are shaped and positioned to retain said cartridges in set positions within said loading chamber.

16. The method according to claim 13, further including providing spacers that rotate between a first position where said spacers extend into said loading chamber and a second position where said spacers are clear of said loading chamber.

17. The method according to claim 16, wherein said spacers are moved from said first position to said second position when contacted by said magazine within said loading chamber.

* * * * *